US010190543B2

(12) United States Patent
Henry

(10) Patent No.: US 10,190,543 B2
(45) Date of Patent: Jan. 29, 2019

(54) METHOD OF OPERATING INTERNAL COMBUSTION ENGINE HAVING INCREASED RICH LIMIT FOR DEDICATED EGR CYLINDER

(71) Applicant: Southwest Research Institute, San Antonio, TX (US)

(72) Inventor: Cary A Henry, Helotes, TX (US)

(73) Assignee: SOUTHWEST RESEARCH INSTITUTE, San Antonio, TX (US)

( * ) Notice: Subject to any disclaimer, the term of this patent is extended or adjusted under 35 U.S.C. 154(b) by 0 days.

(21) Appl. No.: 15/813,410

(22) Filed: Nov. 15, 2017

(65) Prior Publication Data

US 2018/0073472 A1 Mar. 15, 2018

Related U.S. Application Data

(62) Division of application No. 14/709,317, filed on May 11, 2015, now abandoned.

(51) Int. Cl.

| | |
|---|---|
| ***F02M 26/40*** | (2016.01) |
| ***F02M 26/01*** | (2016.01) |
| ***F02M 26/41*** | (2016.01) |
| ***F01L 1/047*** | (2006.01) |
| ***F01L 1/34*** | (2006.01) |
| ***F02M 26/43*** | (2016.01) |
| *F01L 1/053* | (2006.01) |

(52) U.S. Cl.

CPC ..... *F02M 26/40* (2016.02); *F01L 1/047* (2013.01); *F01L 1/34* (2013.01); *F02M 26/01* (2016.02); *F02M 26/41* (2016.02); *F02M 26/43* (2016.02); *F01L 2001/0537* (2013.01); *F01L 2800/10* (2013.01)

(58) Field of Classification Search

CPC ..... F02M 26/40; F02M 26/41; F02M 26/01; F02M 26/43; F01L 1/047; F01L 1/34; F01L 2800/10; F01L 2001/0537

See application file for complete search history.

(56) References Cited

U.S. PATENT DOCUMENTS

| | | | | |
|---|---|---|---|---|
| 2013/0220286 | A1* | 8/2013 | Gingrich | F02D 41/0065 123/568.11 |
| 2013/0239547 | A1* | 9/2013 | Gingrich | F01N 3/101 60/274 |
| 2014/0142833 | A1* | 5/2014 | Gingrich | F02D 41/0255 701/103 |
| 2014/0196697 | A1* | 7/2014 | Burrahm | F02M 26/43 123/568.11 |
| 2015/0114341 | A1* | 4/2015 | Geckler | F02D 41/0065 123/295 |
| 2015/0219028 | A1* | 8/2015 | Gingrich | F02M 26/43 123/445 |
| 2015/0377188 | A1* | 12/2015 | Gingrich | F02B 61/00 60/278 |

(Continued)

*Primary Examiner* — Sizo B Vilakazi

(74) *Attorney, Agent, or Firm* — Livingston Law Firm

(57) ABSTRACT

A method of providing internal EGR to an engine having at least one dedicated EGR cylinder. The main (non dedicated) cylinders are operated with internal EGR, in addition to external EGR from the dedicated EGR cylinder. The dedicated EGR cylinder has separate valve control so that it need not be operated with internal EGR, thereby allowing it to be operated at a richer air-to-fuel ratio.

6 Claims, 3 Drawing Sheets

(56) References Cited

U.S. PATENT DOCUMENTS

| | | | | |
|---|---|---|---|---|
| 2016/0017847 | A1* | 1/2016 | Hilditch | F02D 41/0052<br>123/406.48 |
| 2016/0040589 | A1* | 2/2016 | Glugla | F02D 41/0082<br>60/278 |

* cited by examiner

METHOD OF OPERATING INTERNAL COMBUSTION ENGINE HAVING INCREASED RICH LIMIT FOR DEDICATED EGR CYLINDER

PRIOR-FILED APPLICATION

This application is a divisional of U.S. application Ser. No. 14/709,317, filed May 11, 2015, and claims the benefit of that filing date.

TECHNICAL FIELD OF THE INVENTION

This invention relates to internal combustion engines, and more particularly to such engines having one or more dedicated EGR cylinders and to expanding the rich limit of the dedicated EGR cylinder(s).

BACKGROUND OF THE INVENTION

For many internal combustion engines, their engine control strategy has three important parameters: spark timing (or fuel injection timing in a diesel engine), the exhaust gas recirculation (EGR) rate and the air/fuel ratio (AFR).

To implement EGR, a fraction of the exhaust gas is recycled from the exhaust system back to the intake system. The recirculated exhaust gas is mixed with the fresh fuel-air mixture before entering the cylinders. EGR can be implemented in internal and external configurations. External configurations can be implemented as either a high pressure or low pressure loop, depending on whether the recirculated exhaust is introduced to the intake post compressor (high pressure loop) or pre-compressor (low pressure loop).

EGR has a long history of use in both diesel and spark-ignited engines for reduction of NOx emissions. It affects combustion in several ways. The combustion is cooled by the presence of exhaust gas, that is, the recirculated exhaust gas absorbs heat. The reduction of peak gas temperatures in the combustion chamber reduces the production of NOx.

One approach to implementing EGR is with one or more dedicated EGR cylinders. In a "dedicated EGR" engine, the one or more dedicated cylinders are used to generate exhaust gas, all of which is dedicated to recirculation. With dedicated EGR, the quality of the recirculated exhaust can be improved with in-cylinder reforming of gasoline to H2 and CO. Subsequent combustion of this exhaust, mixed with the fresh air intake to produce the intake charge, is thereby enhanced.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

The following description is directed to systems and methods for improving the operation of an internal combustion engine having dedicated EGR. As stated in the Background, in a "dedicated EGR" engine, one or more of the engine's cylinders is used to generate exhaust gas to be recirculated to the intake charge of the entire engine.

The dedicated EGR may be produced by a cylinder having a single exhaust port that opens only to an EGR loop. The other cylinders produce "normal" exhaust, i.e., exhaust that exits the engine via one or more exhaust aftertreatment devices. U.S. Pat. No. 8,291,891, entitled "EGR System with Dedicated EGR Cylinders", to Alger, et al., and U.S. Pat. No. 8,561,599 entitled "EGR Distributor Apparatus for Dedicated EGR Configuration", to Gingrich et al., both describe systems that generate dedicated EGR in this manner and are incorporated by reference herein.

A feature of dedicated EGR is that the composition of the dedicated EGR exhaust gas may be controlled to be different from that of the exhaust of the non-dedicated cylinders. For example, the dedicated EGR cylinder(s) may be operated rich of stoichiometric to provide EGR that improves combustion on all cylinders.

Thus, in a dedicated EGR engine, the dedicated and non dedicated cylinders may receive different amounts of fuel, with the dedicated EGR cylinder receiving a lower air-to-fuel ratio. This is in contrast to a conventional engine, in which the cylinders are typically fueled such that all cylinders receive the same amount of fuel.

As explained below, a feature of the invention is the recognition that the rich limit of the dedicated EGR cylinder can be increased by using internal EGR for only the main (non dedicated) cylinders. This may be achieved by controlling the intake and/or exhaust valves of the dedicated EGR cylinder independently of the valves of the main cylinders.

Example and Overview of Engine with Dedicated EGR

Figure 1:
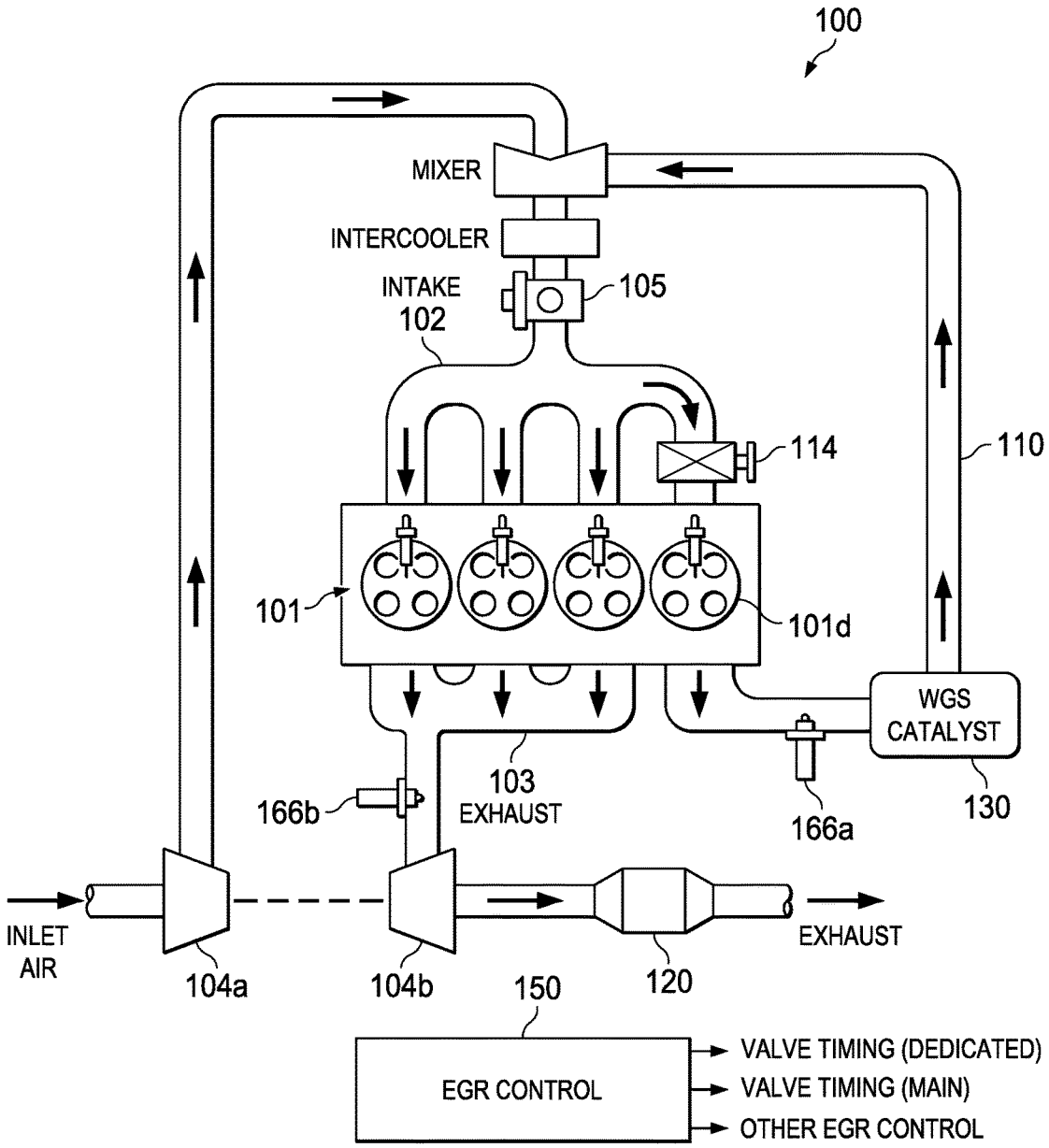
FIG. 1 illustrates an example of an internal combustion engine having a dedicated EGR cylinder.

FIG. 1 illustrates an internal combustion engine 100 having four cylinders 101. One of the cylinders is a dedicated EGR cylinder, and is identified as cylinder 101*d*.

In the example of this description, engine 100 is spark ignited, with each cylinder 101 having an associated spark plug, and its "normal" air-fuel ratio is stoichiometric. However, the methods described herein are also suitable for use with compression ignited engines, or engines operating at an air-fuel ratio other than stoichiometric. In general, the engine's non-dedicated EGR cylinders 101 can be operated with whatever air-fuel ratio is appropriate for the engine.

The dedicated EGR cylinder 101*d* may be operated at any desired air-fuel ratio. All of its exhaust is recirculated back to the intake manifold 102. The exhaust of the other three cylinders 101 (referred to herein as the "main" or "non dedicated" cylinders) is directed to an exhaust system via an exhaust manifold 103.

Engine 100 is equipped with a turbocharger, specifically a compressor 104*a* and a turbine 104*b*. Although not explicitly shown, all cylinders have some sort of fuel delivery system for introducing fuel into the cylinders. This fuel delivery system can be fumigated, port injected, or direct injected.

In the example of this description, fueling is provided by direct injection. For the dedicated cylinder, over-fueling, for a rich air-to-fuel ratio, is achieved by extending the duration of fuel injection.

In the example of this description, the EGR line 110 joins the intake line downstream the compressor 104*a*. A throttle 105 is used to control the amount of intake (fresh air and EGR) into the intake manifold 102.

An EGR valve 114 may be used to control the intake into the EGR cylinder 101*d*. Other means, such as variable valve timing, alternatively may be used to control EGR flow.

In other embodiments, there may be a different number of engine cylinders 101, and/or there may be more than one dedicated EGR cylinder 101*d*. In general, in a dedicated EGR engine configuration, the exhaust of a sub-group of cylinders is routed back to the intake of all the cylinders, thereby providing EGR for all cylinders.

After entering the cylinders 101, the fresh-air/EGR mixture is ignited and combusts. After combustion, exhaust gas from each cylinder 101 flows through its exhaust port and into exhaust manifold 103. From the exhaust manifold 103, exhaust gas then flows through turbine 104*b*, which drives compressor 104*a*. After turbine 104*b*, exhaust gas flows to an exhaust aftertreatment device 120, to be treated before exiting to the atmosphere.

As stated above, the dedicated EGR cylinder 101*d* can operate at any equivalence ratio because its exhaust will not exit the engine before passing through a non-dedicated EGR cylinder 101 operating at a stoichiometric air-fuel ratio. Because only stoichiometric exhaust leaves the engine, the exhaust aftertreatment device 120 may be a three way catalyst. In embodiments in which the engine system is a lean burn system, the exhaust from the non dedicated ("main") EGR cylinders will pass through an appropriate exhaust aftertreatment device, such as a lean NOx trap, NOx adsorber or selective reduction catalyst.

To control the air-fuel ratio, exhaust gas may be sampled by an exhaust gas oxygen (EGO) sensor. Both the main exhaust line 122 and the EGR loop 110 may have a sensor (identified as 166*a* and 166*b*), particularly because the dedicated EGR cylinder may be operated at a different air-fuel ratio than non dedicated cylinders.

If a dedicated EGR cylinder is run rich of stoichiometric A/F ratio, a significant amount of hydrogen (H2) and carbon monoxide (CO) may be formed in the exhaust gas of the dedicated EGR cylinder. Rich combustion products such as these are often termed "syngas". Benefits of combustion with hydrogen-rich EGR are numerous, but include engine efficiency improvements and emissions improvements (NOx, CO, and PM reduction).

An EGR control unit 150 has appropriate hardware (processing and memory devices) and programming for performing the methods described herein. In addition, control unit 150 may perform other tasks, such as overall EGR control, and may be integrated with a comprehensive engine control unit. As described below, for purposes of this description, an important task of control unit 150 is the generation of control signals for valve timing of the cylinders' intake and/or exhaust valves. These control signals determine whether or not a cylinder will retain exhaust in-cylinder for internal EGR. In an engine in which its valves are operated via a camshaft and cams, the control signals will determine the camshaft operation.

Use of Valve Timing for Internal EGR

In the four-cylinder dedicated engine of FIG. 1, all of the exhaust gas from the dedicated EGR cylinder 101*d* is recirculated to all four cylinders. Thus, the EGR component in the charge mixture is nominally 25%.

Figure 2:
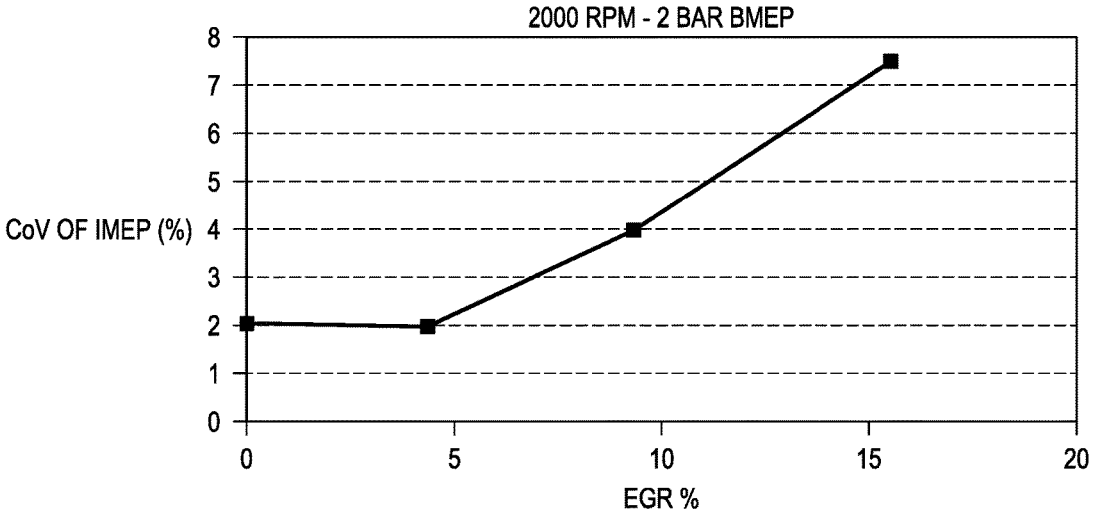
FIG. 2 illustrates CoV of IMEP as a function of the EGR fraction.

FIG. 2 illustrates CoV of IMEP as a function of the EGR fraction. CoV of IMEP is a statistical quantification of the variation in indicated power produced during consecutive combustion cycles. An increase of CoV of IMEP indicates a decrease in combustion stability.

As illustrated, combustion stability is highly dependent on the amount of EGR dilution in the intake charge mixture. However, if H2 and CO are added to the charge mixture, combustion stability improves. With dedicated EGR, the main cylinders of the engine can operate in a stable condition with 25% EGR.

In addition to receiving dedicated EGR, the engine of FIG. 1 can be operated with "internal EGR" provided to its main cylinders. This will increase the EGR rate to more than the nominal 25% amount. Internal EGR is a result of intake and exhaust valve overlap. With valve overlap, the valve timing is arranged so that there is some back-flow into the combustion chamber from the exhaust. In other words, all exhaust gases are not pushed out of the combustion chamber on the exhaust stroke. This retained exhaust is referred to as "internal EGR".

For this purpose, engine 100 is equipped with separate control of the valves of the main cylinders 101 vis-a-vis the valves of the dedicated EGR cylinder 101*d*. In other words, control unit 150 is programmed to provide valve control signals to the main cylinders that are independent of the valve control signals to the dedicated EGR cylinder. Specifically, the valve control signals to the main cylinders may be used to open and close the cylinder intake and exhaust valves of the main cylinders to provide internal EGR.

To implement internal EGR, various valve control strategies may be used. Two examples are control of valve timing and control of valve lift. For engine 100, the use of internal EGR for the main cylinders increases the EGR rate above the nominal rate of 25% for those cylinders.

Figure 3:
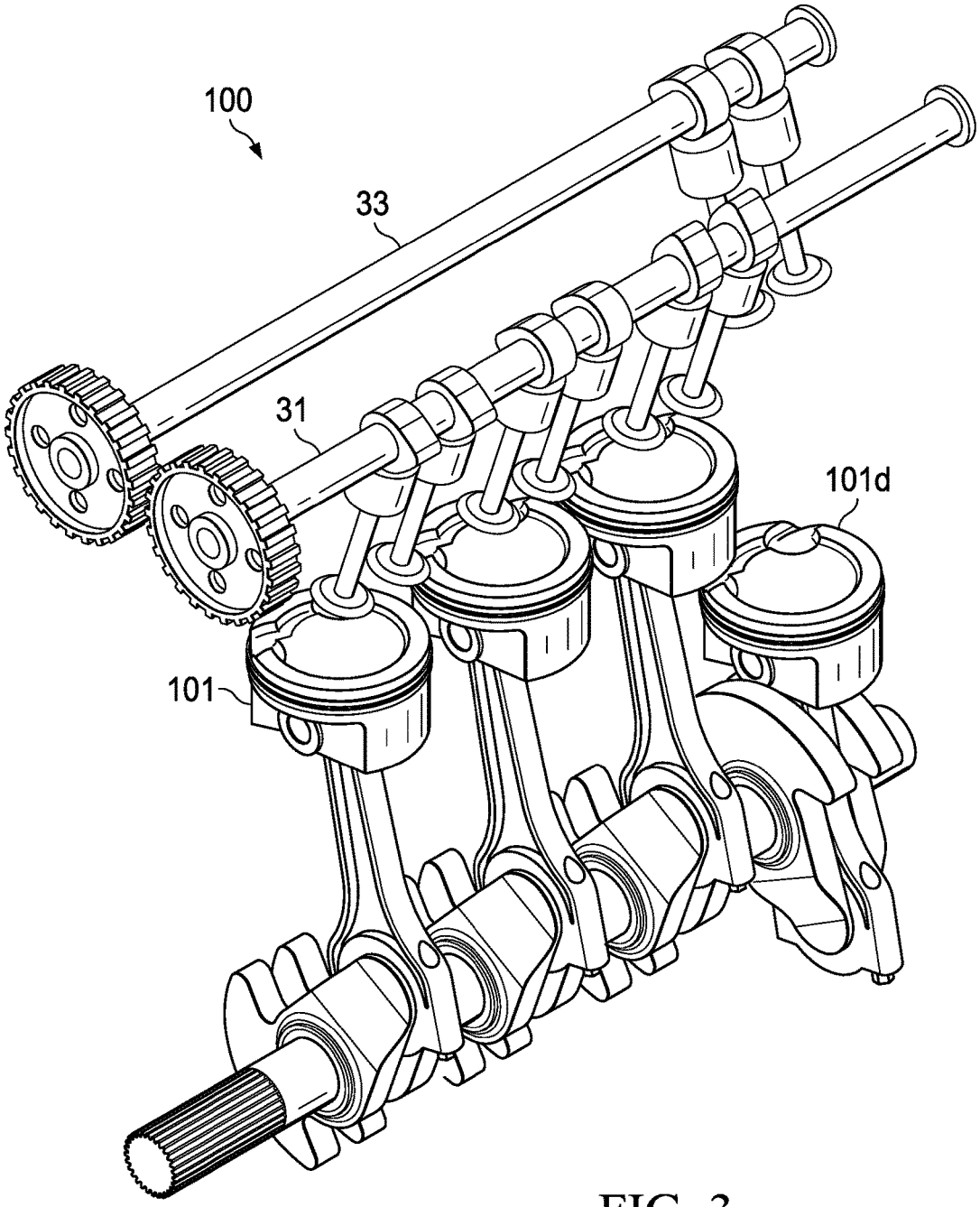
FIG. 3 illustrates an example of how independent valve control for a dedicated EGR cylinder may be achieved.

FIG. 3 illustrates one example of independent valve control for a dedicated EGR engine, such as engine 100. Engine 100 is equipped with two camshafts 31 and 33. Camshaft 31 and its cams operate the valves of non dedicated cylinders 101. Camshaft 33 and its cams operate the valves of the dedicated EGR cylinder 101*d*. As explained above, the valve timing of camshaft 31 may be controlled to produce (or not produce) internal EGR. To produce internal EGR, the camshaft 31 operates with a valve overlap during which both the intake valve and the exhaust valve are open, thus trapping exhaust gas within the associated cylinders 101 by not fully expelling it during the exhaust stroke. In contrast, the valve timing of camshaft 33 is controlled to not produce internal EGR.

There are various alternative embodiments for implementing independent valve control for dedicated EGR cylinders. The following alternative embodiments are suitable, and others may be possible. The camshafts for the main cylinders and dedicated EGR cylinder(s) may be fully independent. All cylinders could use the same camshaft, but with cams that provide different lift and duration for the dedicated EGR cylinder. A "cam-in-cam" system could allow for independent variation in lift and/or duration for the dedicated EGR cylinder(s). A rocker-style switching system could provide lift and/or duration offset for the dedicated EGR cylinder.

Increased Rich Limit for Dedicated EGR Cylinder(s)

As indicated above, stoichiometric spark-ignited engines equipped with dedicated EGR have been successful at improving engine performance. Producing more H2 with the dedicated EGR cylinder(s) results in improved combustion stability, combustion duration, and knock tolerance in the main cylinders. However, a major limitation of such improvements is limitations on the amount of H2 reformate produced by a dedicated EGR cylinder. Because H2 is produced by rich combustion in a dedicated EGR cylinder, the amount of H2 that can be produced is constrained by the rich limit of the dedicated EGR cylinder.

Figure 4:
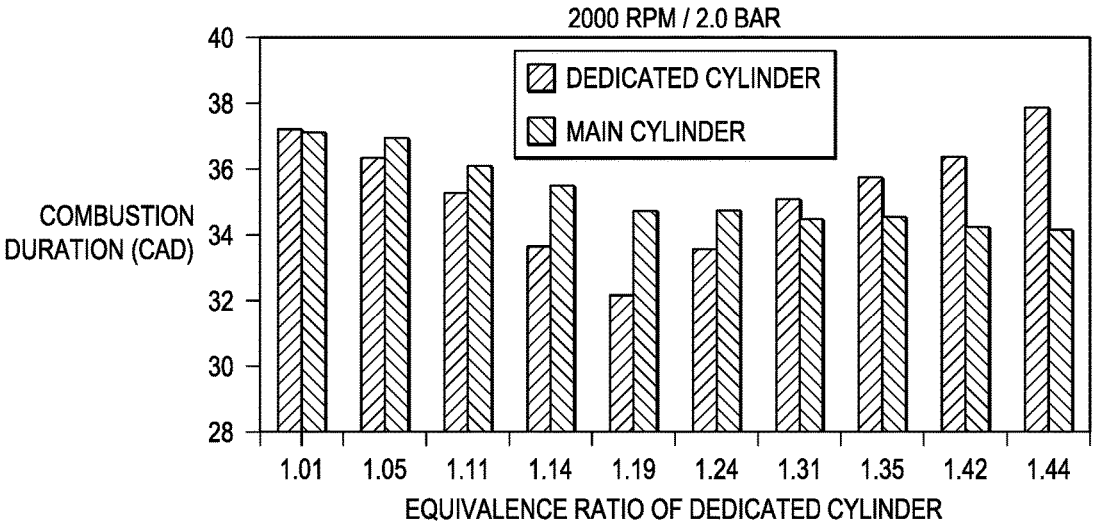
FIG. 4 illustrates combustion duration in a dedicated EGR cylinder and main cylinders as a function of the equivalence ratio of the dedicated EGR cylinder.

FIG. 4 illustrates, for engine 100, combustion duration in the dedicated and main cylinders as a function of the equivalence ratio of the dedicated EGR cylinder. When the intake charge mixture is enriched in the dedicated EGR cylinder (to produce H2 and CO), combustion stability in the dedicated EGR cylinder initially improves to an equivalence ratio of 1.10-1.20 due to an increase in the laminar burning velocity of the mixture. However, as the equivalence ratio increases beyond this limit, combustion stability decays rapidly due to a reduction in laminar burning velocity.

One approach to extending the rich combustion limit of the dedicated EGR cylinder is to reduce the amount of residual or burned gas present in its combustion chamber at the start of combustion. This reduction of EGR in the charge mixture, results in increased laminar burning velocity and improved combustion stability.

To accomplish this reduction of EGR in the combustion chamber, the dedicated EGR cylinder 101*d* is operated with independently controlled valve timing. When the main cylinders 101 are operated with internal EGR, independent valve control allows the dedicated EGR cylinder 101*d* to not retain internal EGR. The external EGR rate of the dedicated EGR cylinder may remain at the nominal 25% fraction (assuming a three-to-one dedicated cylinder engine configuration). This exclusion from internal EGR for the dedicated EGR cylinder 101*d* allows it to be run more rich than if it were operated with internal EGR.

As stated above, the main cylinders benefit from internal residuals under certain engine operating conditions, and have lower fuel consumption with the 25% external EGR added to internal exhaust residuals. For this reason, it is desired to have independent valve control for the dedicated cylinder. This independent valve control means that internal exhaust residuals in the dedicated cylinder can be controlled independently of the main cylinders.

By not using internal EGR in the dedicated EGR cylinder, an improvement in combustion stability enables operation of the dedicated EGR cylinder at a higher equivalence ratio. By operating the dedicated cylinder at a higher equivalence ratio, more H2 and CO can be produced. This increase in H2 and CO in the charge mixture enables further improvements in fuel efficiency by improving combustion stability and the ratio of specific heats in the main cylinders, as shown in FIG. 4. Improving combustion stability also results in reduced hydrocarbon, carbon monoxide, and particulate emissions from the main cylinders, thus reducing the required effectiveness of the emission control system.

If engine 100 is equipped with variable valve timing, as well as independent valve control for the dedicated EGR cylinder, internal EGR can be further controlled. Variable valve timing can give both maximum power at high rpm and smooth idling at low rpm by making small changes to the relative angular position of the camshaft and thereby varying the valve overlap.

With variable valve timing, as well as independent control of the dedicated EGR cylinder valves, internal EGR can be used or not used, depending on engine operating conditions. For example, during light loads it may be more advantageous to operate the main cylinders with internal EGR. Other engine conditions may call for no internal EGR. Referring again to FIG. 3, if internal EGR is to be implemented for only the main cylinders, only camshaft 31 need operate with variable valve timing.

What is claimed is:

1. A method of operating an engine having at least one dedicated EGR cylinder, with the remaining cylinders being main cylinders, comprising:

operating the main cylinders at a first air-fuel ratio;

determining a rich operating limit of the dedicated EGR cylinder operating without internal EGR;

operating the dedicated EGR cylinder at a second air-fuel ratio that is at or below the rich operating limit;

controlling the intake and/or exhaust valves of the main cylinders such that the main cylinders retain exhaust gas, thereby providing internal EGR to only those cylinders, during all or some operating conditions of the engine; and controlling the intake and/or exhaust valves of the dedicated EGR cylinder independently of the intake and/or exhaust valves of the dedicated EGR cylinder, such that the dedicated EGR cylinder never receives internal EGR at any load of the engine.

2. The method of claim 1, wherein the step of controlling the intake and/or exhaust valves of the main cylinders is performed with valve timing control.

3. The method of claim 1, wherein the step of controlling the intake and/or exhaust valves of the main cylinders is performed with valve lift control.

4. The method of claim 1, wherein the main cylinder valves are operated with a camshaft, and the step of controlling the intake and/or exhaust valves of the dedicated EGR cylinder is performed by providing a separate camshaft for the dedicated EGR cylinder.

5. The method of claim 1, wherein the step of controlling the intake and/or exhaust valves of the main cylinders is performed such that internal EGR is provided to the main cylinders during light load engine conditions.

6. The method of claim 1, wherein the intake and/or exhaust valves of the main cylinders have variable valve control.

* * * * *